US006712008B1

(12) United States Patent
Habenicht et al.

(10) Patent No.: US 6,712,008 B1
(45) Date of Patent: Mar. 30, 2004

(54) PORTABLE COMPUTER WORK STATION ASSEMBLY

(76) Inventors: Bruce C. Habenicht, 6308 139th Pl., SE., Snohomish, WA (US) 98296; Kathi Habenicht, 6308 139th Pl., SE., Snohomish, WA (US) 98296; Traci Habenicht, 6308 139th Pl., SE., Snohomish, WA (US) 98296

( * ) Notice: Subject to any disclaimer, the term of this patent is extended or adjusted under 35 U.S.C. 154(b) by 43 days.

(21) Appl. No.: 09/853,495

(22) Filed: May 11, 2001

(51) Int. Cl.[7] ..... A47B 57/00

(52) U.S. Cl. ..... 108/96; 108/50.01; 108/147; 248/918

(58) Field of Search ..... 108/50.01, 50.02, 108/96, 106, 147; 312/223.3, 194, 195, 196; 248/918, 405, 422, 284.1; 74/89.45, 490.01; 187/267, 268

(56) References Cited

U.S. PATENT DOCUMENTS

| | | | | | |
|---|---|---|---|---|---|
| 3,393,649 | A | * | 7/1968 | Miotke | 108/147 |
| 3,608,462 | A | * | 9/1971 | Groshong | 108/147 |
| 3,752,949 | A | * | 8/1973 | Nordgren | 100/27 |
| 4,638,969 | A | * | 1/1987 | Brown | 248/122.1 |
| 4,728,293 | A | | 3/1988 | Kole, Jr. | |
| 4,779,922 | A | | 10/1988 | Cooper | |
| 4,880,270 | A | | 11/1989 | Cooper | |
| D329,150 | S | | 9/1992 | Ball | |
| 5,177,912 | A | | 1/1993 | Ball | |
| D353,287 | S | * | 12/1994 | Hemberger | D6/495 |
| 5,683,066 | A | * | 11/1997 | McCann | 249/918 |
| 5,909,934 | A | | 6/1999 | McGraw | |
| 6,026,755 | A | * | 2/2000 | Long | 108/147 |
| 6,158,357 | A | * | 12/2000 | Shih | 108/50.01 |
| 6,182,579 | B1 | * | 2/2001 | Chang | 108/50.1 |
| 6,270,138 | B1 | * | 8/2001 | Laskowski et al. | 108/110 |
| 6,286,794 | B1 | * | 9/2001 | Harbin | 248/918 |
| 6,298,794 | B1 | * | 10/2001 | Brown et al. | 108/50.01 |
| 6,325,352 | B1 | * | 12/2001 | Story | 248/678 |
| 6,374,752 | B1 | * | 4/2002 | Walser | 108/50.01 |
| 6,450,107 | B1 | * | 9/2002 | Sanz Novales | 108/153.1 |

FOREIGN PATENT DOCUMENTS

| | | | | |
|---|---|---|---|---|
| DE | 3619481 | * | 12/1987 | 108/147 |
| EP | 0283103 | * | 9/1988 | 108/147 |
| EP | 0307565 | * | 3/1989 | 108/147 X |

* cited by examiner

*Primary Examiner*—Lanna Mai
*Assistant Examiner*—Hanh V. Tran

(57) ABSTRACT

A portable computer work station assembly for enabling a user to use one's computer in a comfortable position such as from a lounge chair or a bed. The portable computer work station assembly includes a base assembly including an elongate base member and leg members being securely attached to the elongate base member; and also includes an upright housing tower being securely mounted upon the base assembly and extending vertically; and further includes a height adjustment assembly being attached to the upright housing tower; and also includes a keyboard support assembly being adjustably attached to the height adjustment assembly; and further includes a central processing unit support member being attached to the housing tower; and also includes a monitor support assembly being adjustably attached to the height adjustment assembly.

1 Claim, 7 Drawing Sheets

PORTABLE COMPUTER WORK STATION ASSEMBLY

BACKGROUND OF THE INVENTION

1. Field of the Invention

The present invention relates to a portable computer work station and more particularly pertains to a new portable computer work station assembly for enabling a user to use one's computer in a comfortable position such as from a lounge chair or a bed.

2. Description of the Prior Art

The use of a portable computer work station is known in the prior art. More specifically, a portable computer work station heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,880,270; U.S. Pat. No. 4,728,293; U.S. Pat. No. 5,177,912; U.S. Pat. No. 5,909,934; U.S. Pat. No. 4,779,922; and U.S. Pat. No. Des. 329,150.

While these devices fulfill their respective, particular objectives and requirements, the aforementioned patents do not disclose a new portable computer work station assembly. The inventive device includes a base assembly including an elongate base member and leg members being securely attached to the elongate base member; and also includes an upright housing tower being securely mounted upon the base assembly and extending vertically; and further includes a height adjustment assembly being attached to the upright housing tower; and also includes a keyboard support assembly being adjustably attached to the height adjustment assembly; and further includes a central processing unit support member being attached to the housing tower; and also includes a monitor support assembly being adjustably attached to the height adjustment assembly.

In these respects, the portable computer work station assembly according to the present invention substantially departs from the conventional concepts and designs of the prior art, and in so doing provides an apparatus primarily developed for the purpose of enabling a user to use one's computer in a comfortable position such as from a lounge chair or a bed.

SUMMARY OF THE INVENTION

In view of the foregoing disadvantages inherent in the known types of portable computer work station now present in the prior art, the present invention provides a new portable computer work station assembly construction wherein the same can be utilized for enabling a user to use one's computer in a comfortable position such as from a lounge chair or a bed.

The general purpose of the present invention, which will be described subsequently in greater detail, is to provide a new portable computer work station assembly which has many of the advantages of the portable computer work station mentioned heretofore and many novel features that result in a new portable computer work station assembly which is not anticipated, rendered obvious, suggested, or even implied by any of the prior art portable computer work station, either alone or in any combination thereof.

To attain this, the present invention generally comprises a base assembly including an elongate base member and leg members being securely attached to the elongate base member; and also includes an upright housing tower being securely mounted upon the base assembly and extending vertically; and further includes a height adjustment assembly being attached to the upright housing tower; and also includes a keyboard support assembly being adjustably attached to the height adjustment assembly; and further includes a central processing unit support member being attached to the housing tower; and also includes a monitor support assembly being adjustably attached to the height adjustment assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable computer work station assembly which has many of the advantages of the portable computer work station mentioned heretofore and many novel features that result in a new portable computer work station assembly which is not anticipated, rendered obvious, suggested, or even implied by any of the prior art portable computer work station, either alone or in any combination thereof.

It is another object of the present invention to provide a new portable computer work station assembly which may be easily and efficiently manufactured and marketed.

It is a further object of the present invention to provide a new portable computer work station assembly which is of a durable and reliable construction.

An even further object of the present invention is to provide a new portable computer work station assembly which is susceptible of a low cost of manufacture with regard to both materials and labor, and which accordingly is then susceptible of low prices of sale to the consuming public, thereby making such portable computer work station assembly economically available to the buying public.

Still yet another object of the present invention is to provide a new portable computer work station assembly which provides in the apparatuses and methods of the prior art some of the advantages thereof, while simultaneously overcoming some of the disadvantages normally associated therewith.

Still another object of the present invention is to provide a new portable computer work station assembly for enabling a user to use one's computer in a comfortable position such as from a lounge chair or a bed.

Yet another object of the present invention is to provide a new portable computer work station assembly which includes a base assembly including an elongate base member and leg members being securely attached to the elongate base member; and also includes an upright housing tower being securely mounted upon the base assembly and extending vertically; and further includes a height adjustment assembly being attached to the upright housing tower; and also includes a keyboard support assembly being adjustably attached to the height adjustment assembly; and further includes a central processing unit support member being attached to the housing tower; and also includes a monitor support assembly being adjustably attached to the height adjustment assembly.

Still yet another object of the present invention is to provide a new portable computer work station assembly that is easy and convenient to move about and use.

Even still another object of the present invention is to provide a new portable computer work station assembly that eliminates bulking and cumbersome computer furniture.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
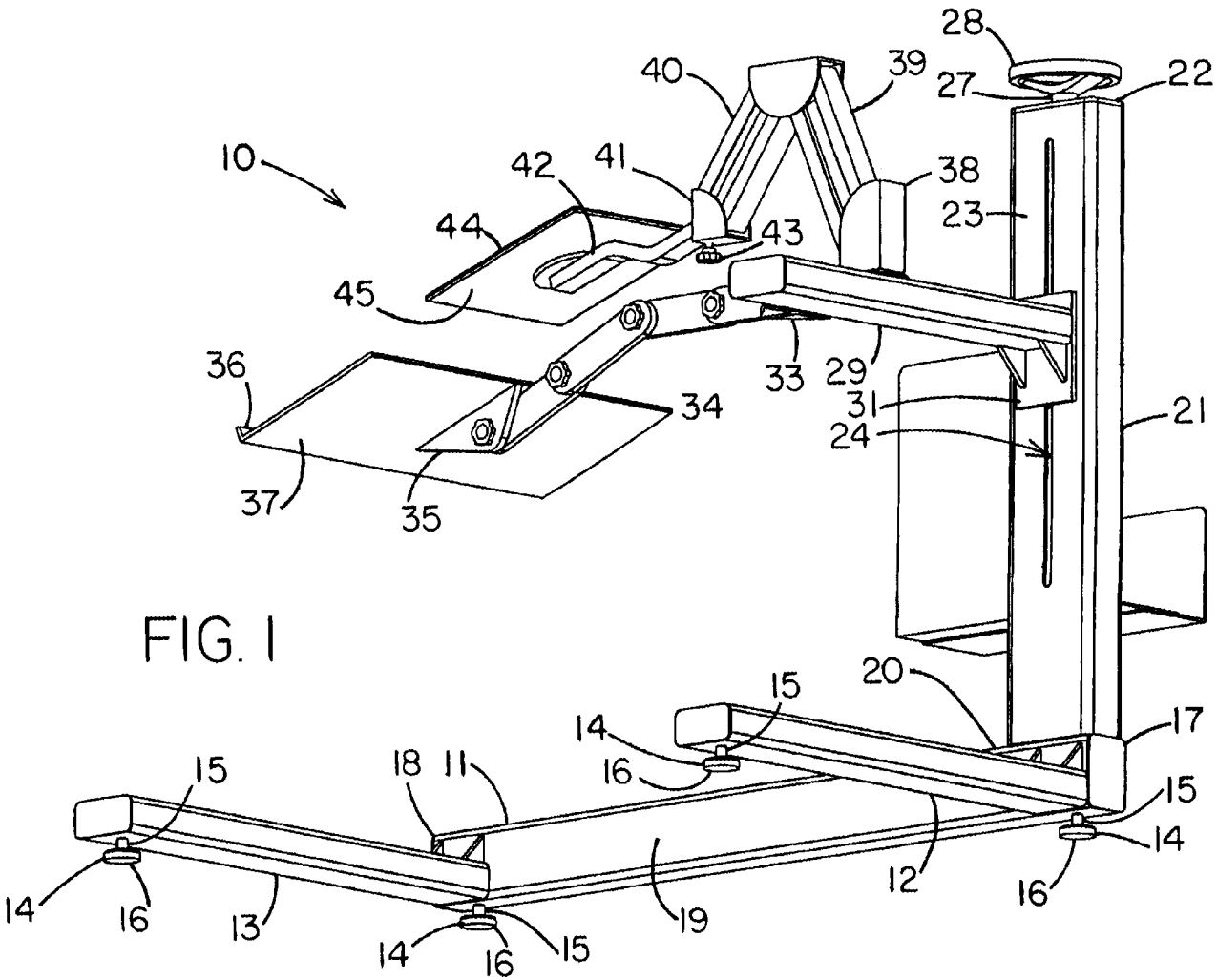
FIG. 1 is a front perspective view of a new portable computer work station assembly according to the present invention.
Figure 2:
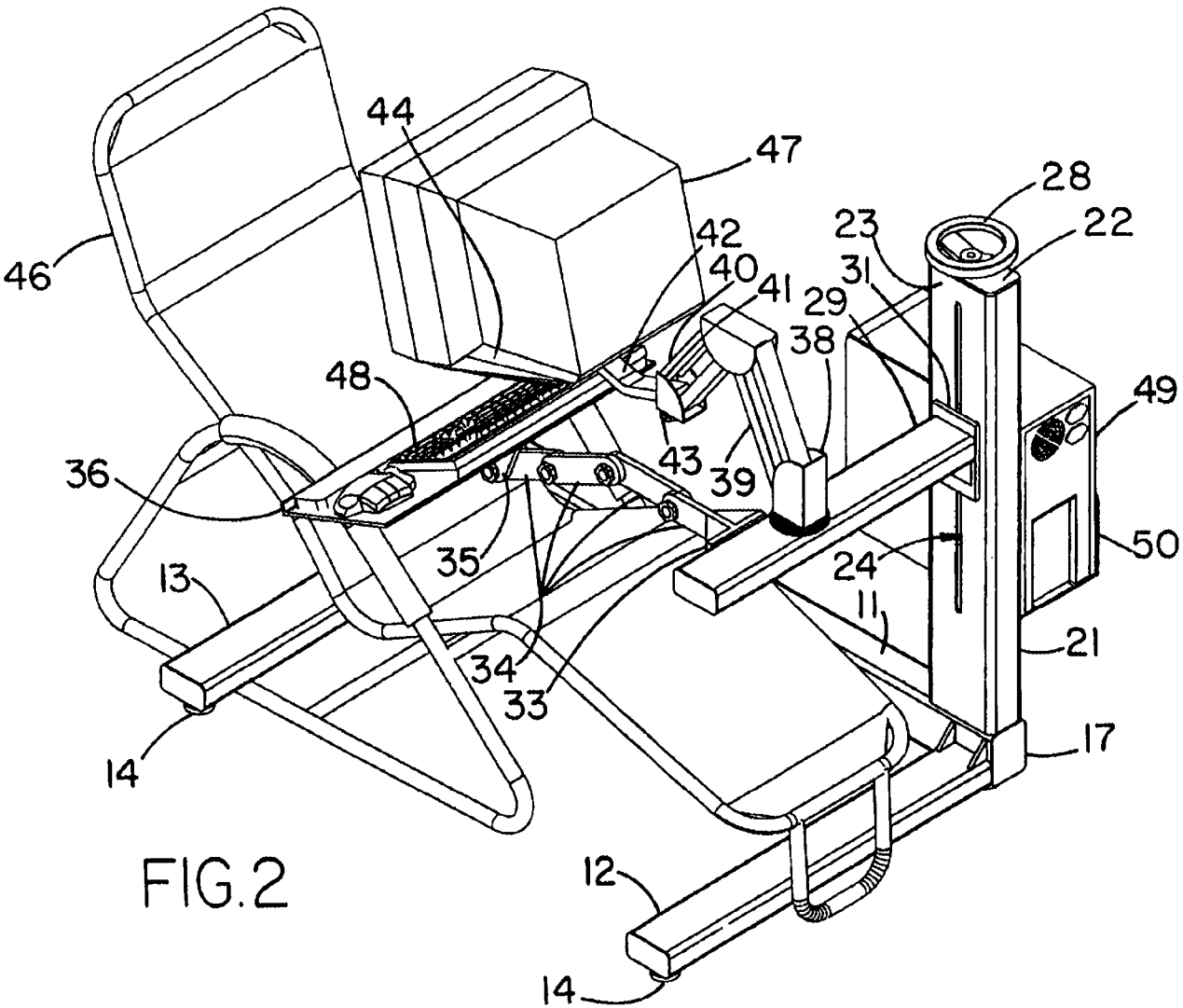
FIG. 2 is another front perspective view of the present invention.
Figure 3:
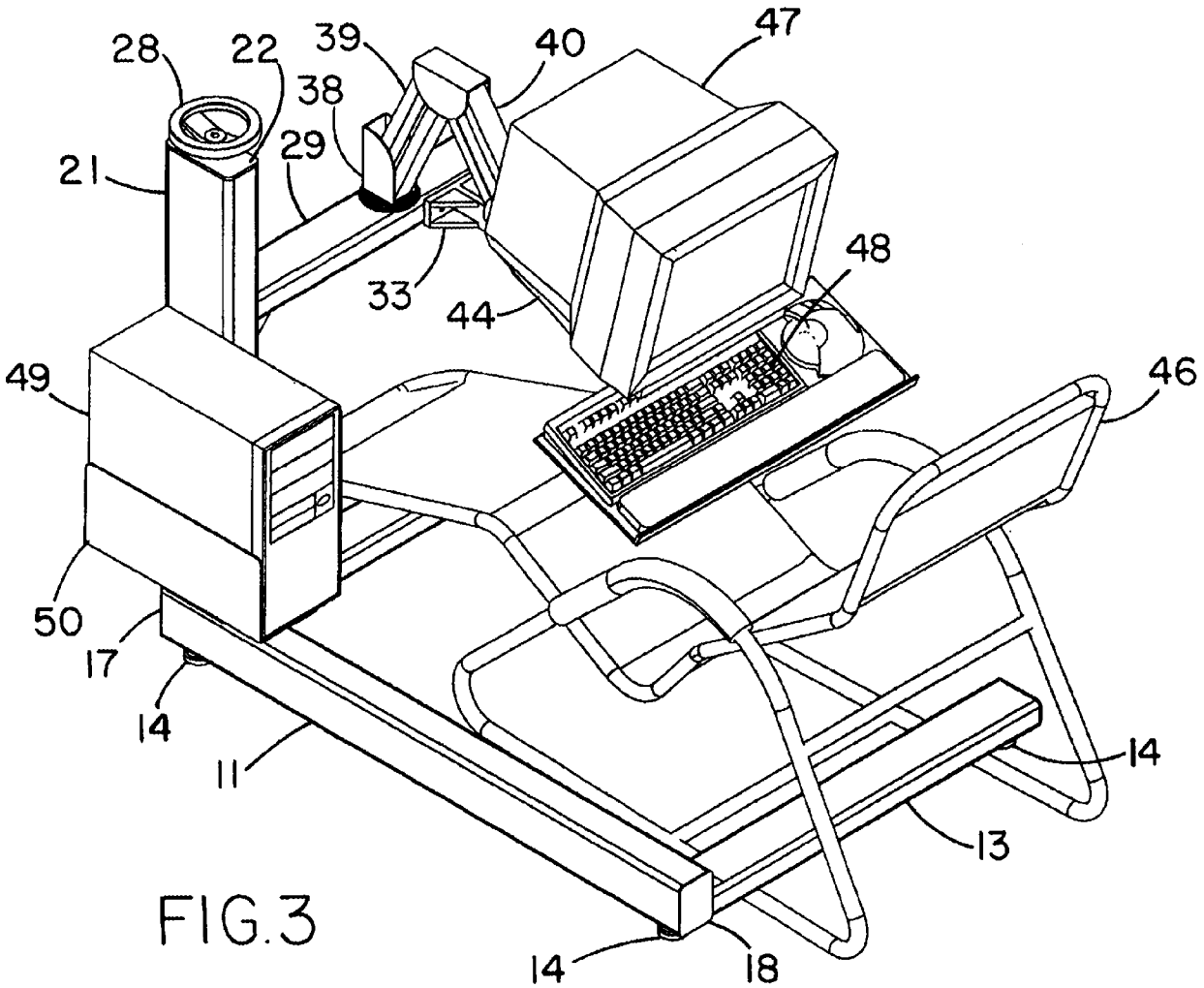
FIG. 3 is a rear perspective view of the present invention.
Figure 4:
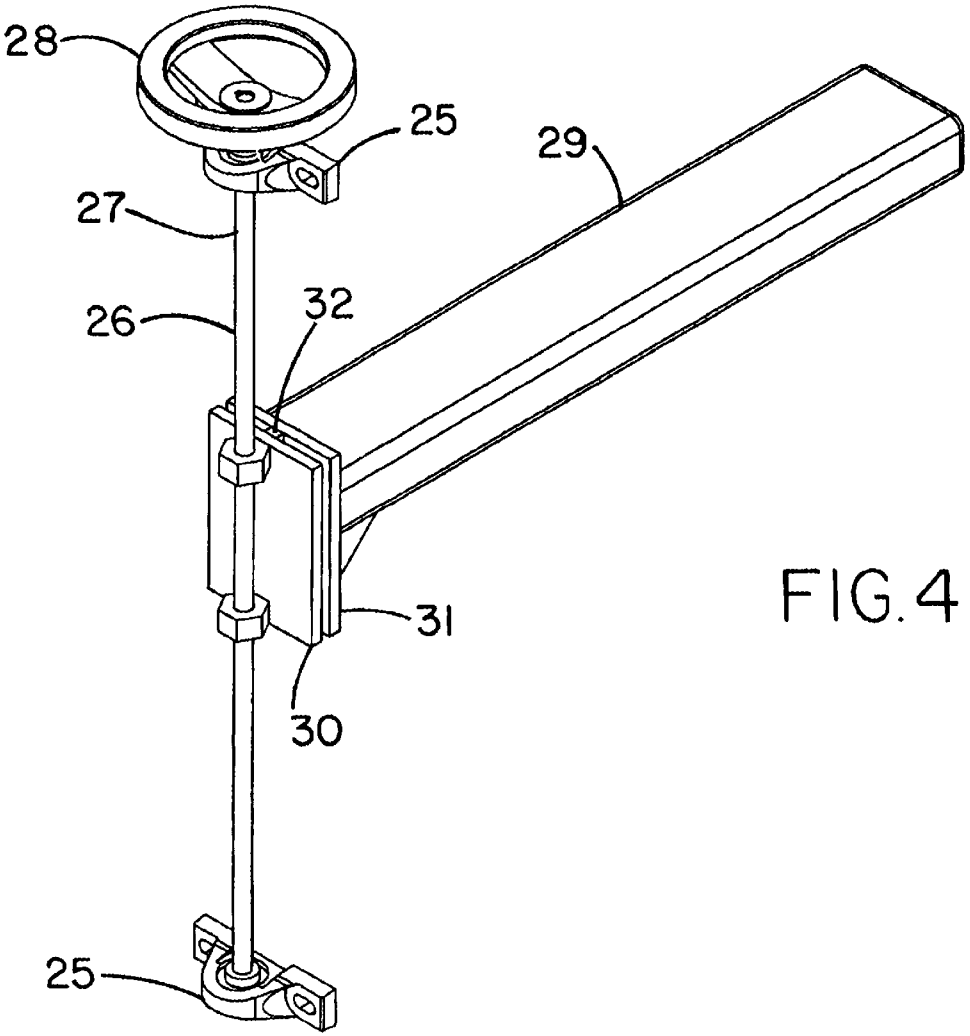
FIG. 4 is a detailed perspective view of the height adjustable assembly of the present invention.
Figure 5:
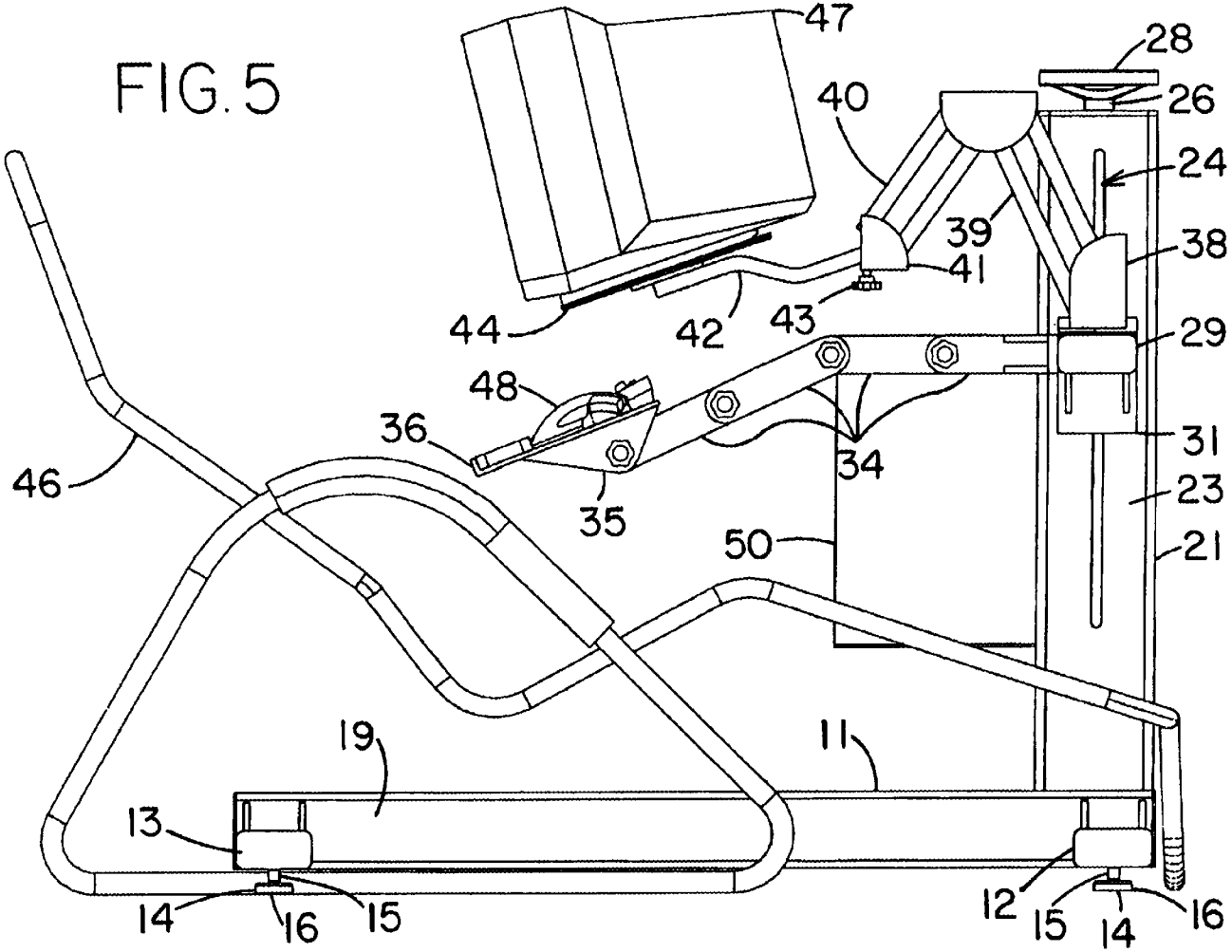
FIG. 5 is a side elevational view of the present invention.
Figure 6:
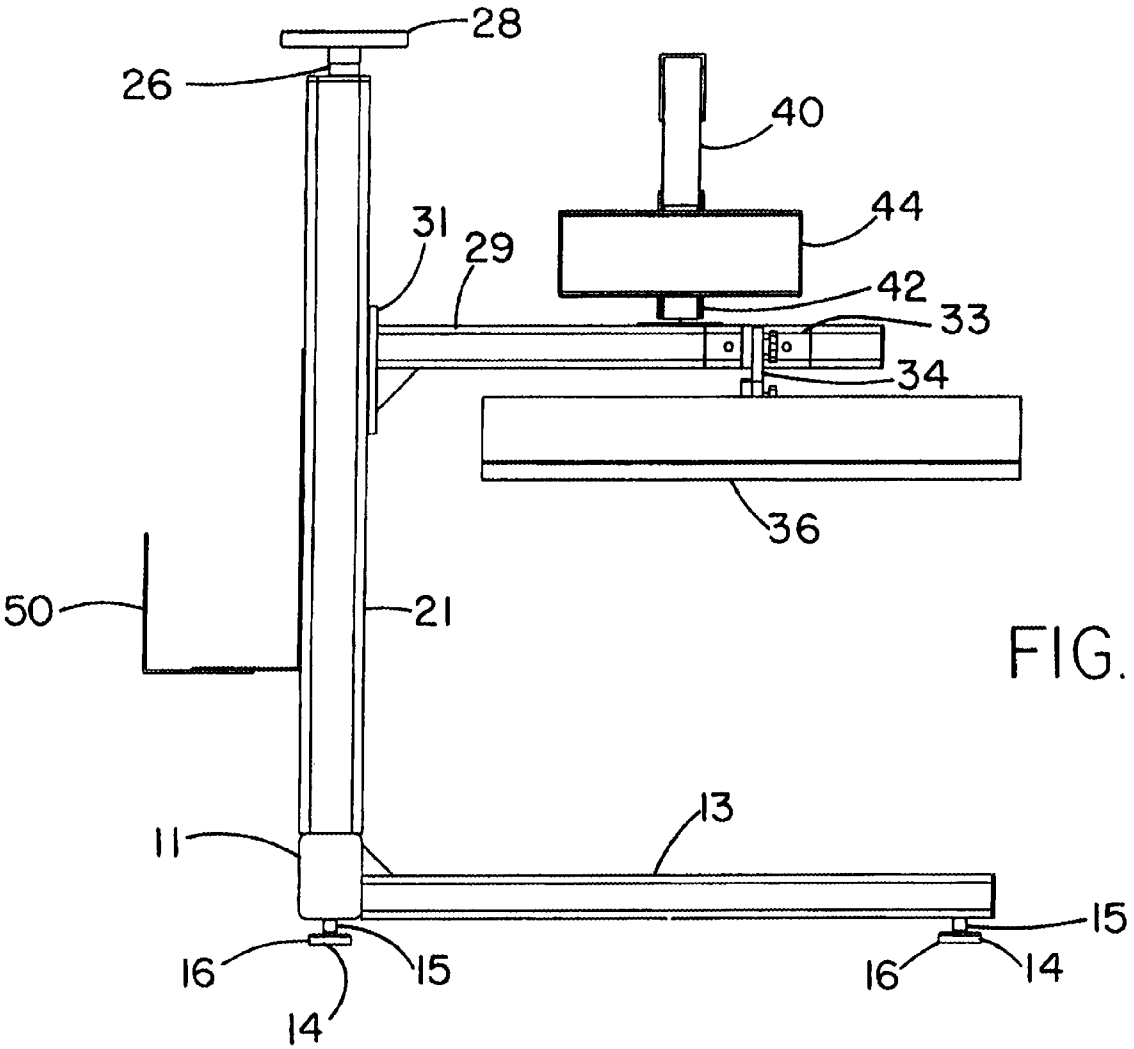
FIG. 6 is a rear elevational view of the present invention.
Figure 7:
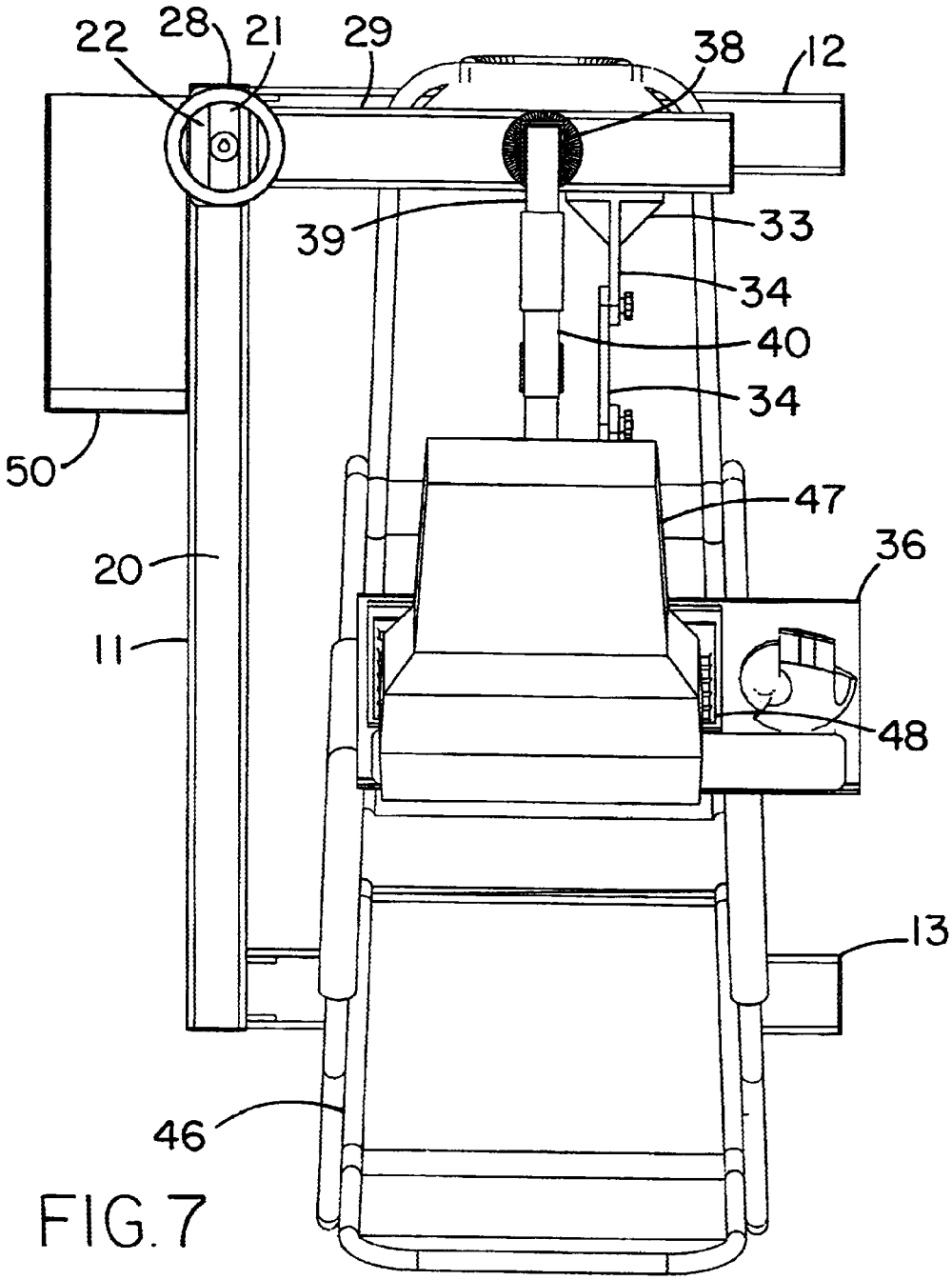
FIG. 7 is a top plan view of the present invention.

With reference now to the drawings, and in particular to FIGS. 1 through 7 thereof, a new portable computer work station assembly embodying the principles and concepts of the present invention and generally designated by the reference numeral 10 will be described.

As best illustrated in FIGS. 1 through 7, the portable computer work station assembly 10 generally comprises a base assembly including an elongate base member 11 and leg members 12,13 being securely and conventionally attached to the elongate base member 11. The base assembly also includes a plurality of leveling members 14 being adjustably attached to bottom walls of the elongate base member 11 and the leg members 12,13. Each of the leveling members 14 includes a threaded shaft 15 which is threaded into the bottom walls of the elongate base member 11 and the leg members 12,13, and further includes a disc-shaped foot member 16 being securely and conventionally attached to an end of the threaded shaft 15 and being adapted to rest upon a ground, and also optionally includes caster wheels (not shown). The elongate base member 11 has a first end 17 and a second end 18. The leg members 12,13 include a first leg member 12 having an end securely and conventionally attached to a side wall 19 of the elongate base member 11 near the first end 17 thereof and extending generally perpendicular to the elongate base member 11, and also include a second leg member 13 having an end securely and conventionally attached to the side wall 19 of the elongate base member 11 near the second end 18 thereof and extending generally perpendicular to the elongate base member 11. An upright housing tower 21 is securely and conventionally mounted upon the base assembly and extend vertically. The housing tower 21 includes top and side walls 22,23, and also includes a longitudinal slot 24 being disposed in the side wall 23 thereof.

A height adjustment assembly is conventionally mounted to the upright housing tower 21. The height adjustment assembly includes a plurality of pillow block bearings 25 being securely and conventionally attached in the housing tower 21 and having inner races with extended collars, and also includes a threaded shaft member 26 being threaded through the pillow block bearings 25 and having a top end 27, and further includes a crank 28 being conventionally attached to the top end 27 of the threaded shaft member 26, and also includes a bracket assembly being movably mounted to the threaded shaft member 26, and further includes an elongate support member 29 being securely and conventionally attached to the bracket assembly. The threaded shaft member 26 extends through the top wall 22 of the housing tower 21. The bracket assembly includes a first plate member 30 being movably disposed in the housing tower 21, and also includes a second plate member 31 being disposed outside of the housing tower 21, and further includes a connector 32 conventionally interconnecting the first and second plate members 30,31 and being received in the longitudinal slot 24 of the housing tower 21. The elongate support member 29 is disposed perpendicular to the second plate member 31 and has an end which is securely attached to the second plate member 31. A central processing unit support member 50 is securely and width-adjustably mounted to the housing tower 21 and includes a bottom plate and a side plate extending upwardly along a longitudinal edge of the bottom plate with the bottom plate being conventionally mounted to the housing tower 21.

A keyboard support assembly is adjustably and conventionally attached to the height adjustment assembly. The keyboard support assembly includes a first bracket 33 being securely and conventionally attached to the elongate support member 29, and also includes a plurality of linkages 34 being pivotally connected end-to-end and being conventionally attached to the first bracket 33, and further including a second bracket 35 being conventionally connected to one of the linkages 35, and also includes a keyboard tray 36 having a bottom side 37 which is conventionally attached to the second bracket 35.

A monitor support assembly is adjustably and conventionally attached to the height adjustment assembly. The monitor support assembly includes a mounting bracket 38 being rotationally adjustable and conventionally attached to the elongate support member 29 but is limited to 90 degrees total rotation, and also includes a first boom 39 being pivotally and conventionally attached to the mounting bracket 38, and further includes a second boom 40 being pivotally and conventionally attached to the first boom 39, and also includes a shelf assembly being adjustably attached to the second boom 39 and being adapted to support a monitor 47. The shelf assembly includes a bracket member 41 being conventionally attached to the second boom 40, and also includes a support arm 42 being adjustably attached to the bracket member 41, and further includes a fastener 43 being threaded into the bracket member 41 and being engagable to the support arm 42, and also includes a support plate 44 having a bottom side 45 which securely and conventionally attached to the support arm 42. The monitor 47 is securely fastened to the support plate 45 with adjustable nylon fastener straps (not shown) which are conventionally attached to the bottom side 45 of the support plate 44 to prevent the monitor from falling off the shelf assembly during movement thereof In use, the user can set up the computer work station assembly 10 almost anywhere it is needed. For example, a lounge chair 46 can be used for the user to comfortably sit in front of a computer. The user would place the lounge chair 46 across the leg members 12,13 and would raise and lower the elongate support member 29 by using the crank 28 for one's comfort. The user would also adjust the keyboard tray 36 and the support plate 44 for the monitor 47 as desired.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A portable computer work station assembly comprising:

a base assembly including an elongate base member and leg members being securely attached to said elongate base member, said base assembly also including a plurality of leveling members being adjustably attached to bottom walls of said elongate base member and said leg members, each of said leveling members including a threaded shaft which is threaded into said bottom walls of said elongate base member and said leg members, and further including a disc-shaped foot member being securely attached to an end of said threaded shaft and being adapted to rest upon a ground, said elongate base member having a first end and a second end, said leg members including a first leg member having an end securely attached to a side wall of said elongate base member near said first end thereof and extending generally perpendicular to said elongate base member, and also including a second leg member having an end securely attached to said side wall of said elongate base member near said second end thereof and extending generally perpendicular to said elongate base member;

an upright housing tower being securely mounted upon said base assembly and extending vertically, said housing tower including top and side walls, and also including a longitudinal slot being disposed in one of said side walls thereof;

a height adjustment assembly being attached to said upright housing tower, said height adjustment assembly including a plurality of pillow block bearings being securely attached in said housing tower, and also including a threaded shaft member being threaded through said pillow block bearings and having a top end, and further including a crank being attached to said top end of said threaded shaft member, and also including a bracket assembly being movably mounted to said threaded shaft member, and further including an elongate support member being securely attached to said bracket assembly, said threaded shaft member being extended through said top wall of said housing tower, said bracket assembly including a first plate member being disposed in said housing tower, and also including a second plate member being disposed outside of said housing tower, and further including a connector interconnecting said first and second plate members and being received in said longitudinal slot of said housing tower, said elongate support member being disposed perpendicular to said second plate member and having an end which is securely attached to said second plate member, a vertical height of said elongate support member with respect to said upright housing tower being adjustable;

a central processing unit support member being securely and width-adjustably mounted to said housing tower and including a bottom plate and a side plate extending upwardly along a longitudinal edge of said bottom plate with said bottom plate being mounted to said housing tower;

a keyboard support assembly being adjustably attached to said height adjustment assembly, said keyboard support assembly including a first bracket being securely attached to said elongate support member, and also including a plurality of linkages being pivotally connected end-to-end and being attached to said first bracket, and further including a second bracket being connected to one of said linkages, and also including a keyboard tray having a bottom side which is attached to said second bracket, a vertical height of said keyboard tray with respect to said height adjustment assembly being adjustable, a horizontal spacing of said keyboard tray with respect to said elongate support member being adjustable; and a monitor support assembly being adjustably attached to said height adjustment assembly, said monitor support assembly including a mounting bracket being securely attached to said elongate support member, and also including a first boom being pivotally attached to said mounting bracket, and further including a second boom being pivotally attached to said first boom, and also including a shelf assembly being adjustably attached to said second boom and being adapted to support a monitor, said shelf assembly including a bracket member being attached to said second boom, and also including a support arm being adjustably attached to said bracket member, and further including a fastener being threaded into said bracket member and being engagable to said support member, and also including a support plate having a bottom side which securely attached to said support arm, a vertical height of said shelf assembly with respect to said height adjustment assembly being adjustable, a horizontal spacing of said keyboard tray with respect to said elongate support member being adjustable.

* * * * *